United States Patent [19]

Kline

[11] 4,437,389

[45] Mar. 20, 1984

[54] AXIAL PISTON PUMP HAVING BARREL BIASING MEANS

[75] Inventor: William L. Kline, Galena, Ohio

[73] Assignee: The Kline Manufacturing Company, Galena, Ohio

[21] Appl. No.: 347,511

[22] Filed: Feb. 10, 1982

[51] Int. Cl.[3] ..... F01B 13/00

[52] U.S. Cl. ..... 91/499; 91/507

[58] Field of Search ..... 91/486, 487, 499, 507

[56] References Cited

U.S. PATENT DOCUMENTS

| | | | |
|---|---|---|---|
| 2,925,046 | 2/1960 | Bodzich | 91/507 |
| 3,124,079 | 3/1964 | Boyer | 91/486 |
| 3,274,897 | 9/1966 | Reinke | 91/507 |
| 3,292,553 | 12/1966 | Hann | 91/486 |
| 3,678,804 | 7/1972 | Heyl | 91/507 |
| 4,232,587 | 11/1980 | Kline | 91/499 |

*Primary Examiner*—William L. Freeh

*Attorney, Agent, or Firm*—Wilson, Fraser, Barker & Clemens

[57] ABSTRACT

An improved fluid energy translating device of the axial piston type includes a cylinder barrel mounted on a drive shaft. The cylinder barrel is rotatably coupled to the drive shaft through a splined connection which includes crowned male splines on the drive shaft and female splines within the cylinder barrel. A port plate having inlet and outlet passages abuts one end of the barrel and intimate contact therebetween is maintained by a plurality of disk or Belleville springs operably disposed between the drive shaft and the cylinder barrel.

9 Claims, 7 Drawing Figures

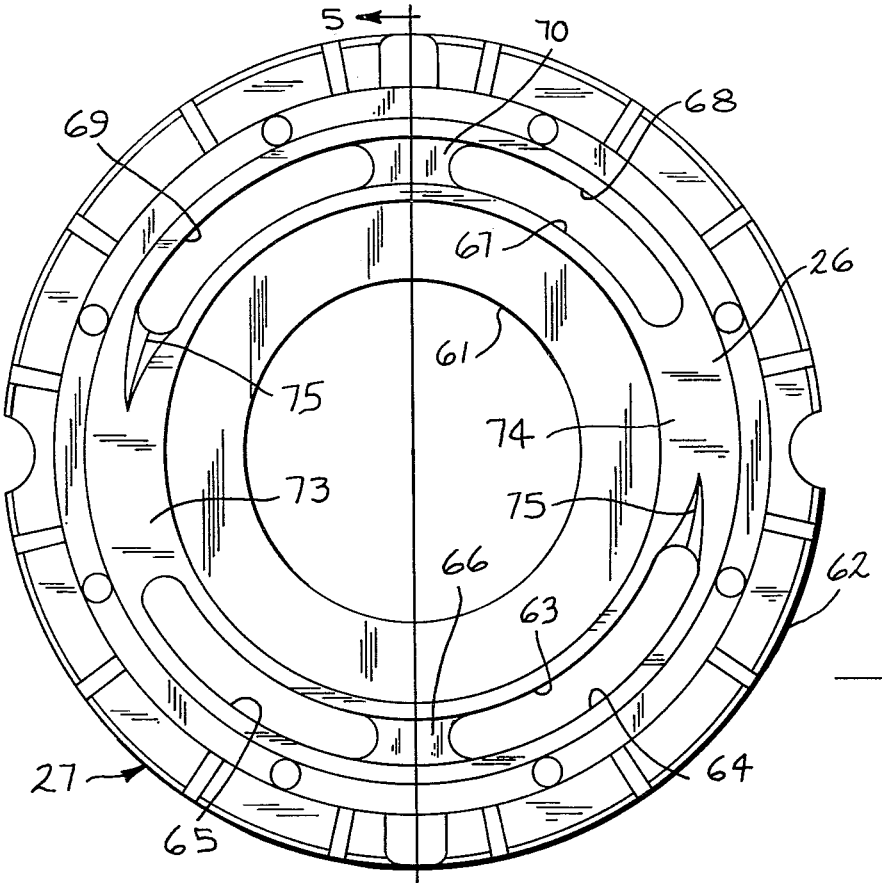
FIG. 4
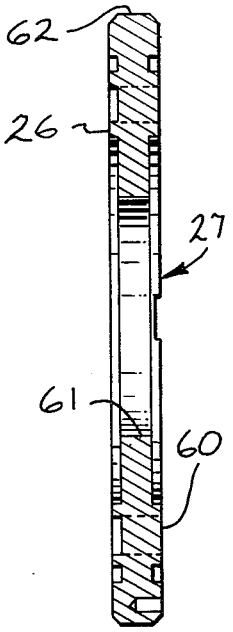
FIG. 5
FIG. 6
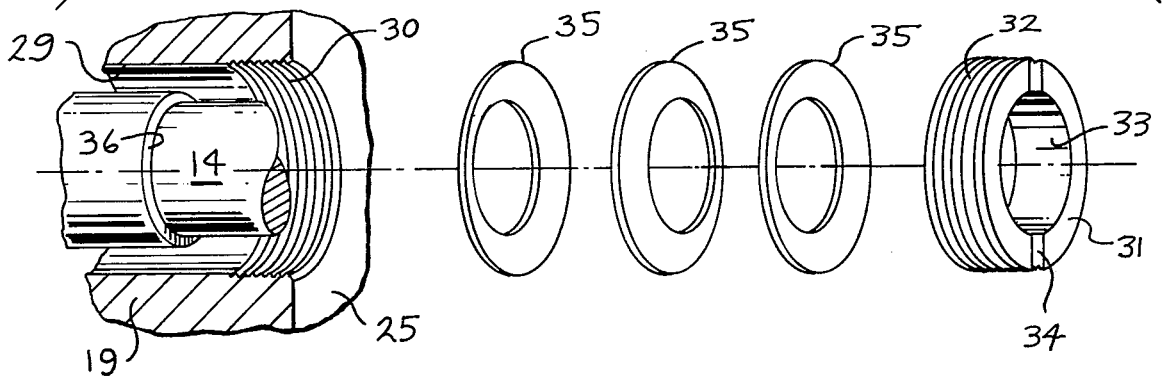
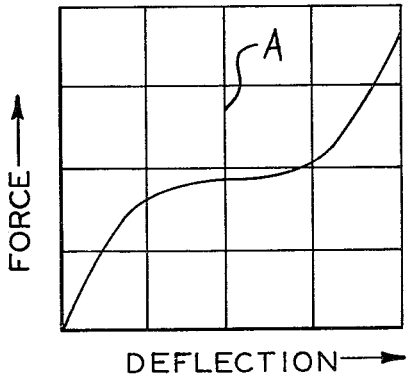
FIG. 7

AXIAL PISTON PUMP HAVING BARREL BIASING MEANS

BACKGROUND OF THE INVENTION

This invention relates to a fluid pressure energy translating device and more particularly to an improved high pressure hydraulic axial piston pump or motor.

Axial piston pumps or motors generally comprise an annular block or barrel defining a plurality of cylinders and aligned passages arranged concentrically about a barrel axis which each slidably receives one of a like plurality of pistons. The pistons include spherical bearings received within shoes which operably couple them to a stationary wobble plate or cam plate disposed adjacent one end of the barrel. The cam plate may be secured at a fixed angle relative to the barrel axis or may be disposed in trunnions such that the angle between the cam plate and barrel axis may be varied. The shoes slide on the cam plate as the barrel is rotated. Reciprocation of the pistons in response to relative rotation between the cam plate and the barrel is thus effected. The barrel is supported on a drive shaft for rotation about its axis and abuts a fixed port plate which engages the end of the barrel opposite the cam plate. The port plate has a pair of ports or passages which provide independent communication between a source of fluid and a discharge line. The ports in the port plate register with the plurality of passages in the barrel which communicate with the individual cylinders so that fluid will be alternately introduced into and discharged from each cylinder as the barrel is rotated and the pistons reciprocate.

In recent years, hydraulic component applications in various industries have become increasingly taxing. For example, axial piston pumps and motors are being asked to far exceed their design capabilities. Increases in both hydraulic pressure and rotational speeds are causing higher rates of failure in axial piston pumps and motors. Failures primarily occur in the form of barrel-port plate separation resulting in a loss in pressure or "blow-off" and loss of shoe contact with the surface of the cam plate.

In order to maintain a fluid seal between the rotating barrel and the fixed port plate under all operating conditions, several requirements must be met. First of all, the mating surfaces must be extremely flat and perfectly parallel. Typically, the mating surfaces are flat to within two lightbands of flatness. Furthermore, proper axial alignment between the barrel and the port plate must be maintained. If the barrel and port plate slightly axially misalign, i.e., tilt relative to one another, increased wear of the mating surfaces on the port plate and the barrel will occur. If the tilt is great enough, system pressure will act on usually unexposed area causing barrel-port plate separation or "blowoff."

Finally, while such a fluid seal is assisted by fluid pressure exerted on the barrel when the device has reached operating speed, it is necessary to provide supplemental biasing means to ensure intimate barrel to port plate contact when the pump or motor is just beginning to rotate or when the variable cam plate is positioned perpendicularly to the barrel axis such that zero flow and zero pressure exists in, for example, an electro-hydraulic servo circuit used to provide cross center (reverse flow). A conventional coil spring has been utilized in prior art designs to provide such bias. The constant force versus deflection relationship of a coil spring as well as the physical placement of the spring generally between the barrel and the drive shaft creates certain assembly and operational difficulties. With regard to the former, since a specific barrel-to-port plate bias is required it must be achieved by compressing the spring an appropriate amount. Variations in spring free length, spring rate, coil end finish, etc., necessitate repeated adjustment, assembly and force measurement steps in order to achieve a desired biasing force in each production unit. With regard to the latter, as the abutting surfaces of the barrel and port plate wear during use, the biasing force will drop in accordance with the spring rate relationship. Since springs suitable for this application exhibit a relatively high spring rate, even a small quantum of wear will result in an appreciable reduction of biasing force and this increased likelihood of improper operation, particularly at low pressures and speeds.

Barrel-port plate contact or alignment is a complex problem since the forces acting upon these components and thus urging them out of alignment are both numerous and dynamic. As noted above, fluid pressurization and pumping by the pistons is accomplished by interaction between the cam plate and piston shoes. The force which the cam plate exerts on each of the piston shoes to pump fluid is balanced by a reaction force in the opposite direction. Due to the inclination of the cam plate, however, this axial reaction force produces a radial component of force tending to move the piston shoes radially away from the barrel axis. The forces from each of the piston shoes may be resolved into a single resultant force acting on the barrel and extending radially from the barrel axis at the point of intersection of the barrel axis and the plane of loci of the centers of the spherical bearings. The magnitude of this force is proportional to the hydraulic fluid pressure. It is therefore dynamic but independent of the rotational speed of the barrel.

A second force tending to tilt the barrel results from centrifugal force. The centers of gravity of certain of the pistons are axially offset from those of diametrically opposed pistons. The centrifugal force on each piston acts through the center of gravity of the piston in a radial direction. Since the centers of gravity of some of the pistons are axially offset from others, an unbalanced centrifugal force is applied to the barrel. The centrifugal force on diametrically opposed offset pistons applies a dynamic couple to the barrel which is the product of the centrifugal force acting on one of the pistons times the axial offset of the centers of gravity of the pistons. The magnitude of this couple will vary from zero in the case of opposed pistons in which the centers of gravity are aligned at right angles to the shaft to a maximum value in the case of opposed pistons in their maximum offset position. The magnitude of the couple is also directly related to speed.

A general solution to these problems which has been incorporated into the design of most contemporary axial piston pumps comprehends restraining either the barrel or port plate while permitting the other a certain amount of orientation freedom. Through this approach, barrel-port plate misalignment which might result in leakage and blow-off is minimized since tilting or skewing of one of the elements may be accommodated by movement of the other. Another approach is disclosed in my prior U.S. Pat. No. 3,126,835. By supporting the barrel on a bearing on a drive shaft extending coaxially through the barrel and by properly locating the bearing, the effects of the dynamic couple resulting from centrifugal force may be offset at least in part by the effects of the resultant force from fluid pressure acting on the pistons.

The unequal forces acting on the barrel also tend to slightly deflect the drive shaft which supports the barrel. If the barrel is rigidly connected to the drive shaft and the drive shaft deflects or bends slightly under loading, the barrel will tilt relative to the port plate and a loss of fluid pressure will occur. In my prior U.S. Pat. Nos. 3,126,835 and 3,160,109, a loss of fluid pressure resulting from deflection or bending of the drive shaft is reduced through the use of a torque tube interconnecting the drive shaft with the barrel and through the use of a crowned bearing between the drive shaft and the barrel. The torque tube extends coaxially along the drive shaft between the drive shaft and the barrel and has one end connected through splines to the drive shaft and an opposite end connected through splines to the barrel. As the shaft is driven, the torque tube in turn drives the barrel. The splines between the drive shaft and the torque tube and between the torque tube and the barrel also may be crowned to allow the shaft to flex relative to the barrel without tilting the barrel, as taught in my U.S. Pat. No. 4,232,587. As the drive shaft flexes under loading, the barrel is permitted to slide on the port plate without tilting away from the port plate. This construction has been effective in greatly reducing or eliminating tilting of the barrel and the resulting hydraulic fluid leakage.

SUMMARY OF THE INVENTION

According to the present invention, an improved axial piston hydraulic device is provided for operation either as a pump or a motor. The pump or motor provides a direct spline connection between a drive shaft and the barrel, allowing the pump to be adapted to higher operating speeds and loads. A spring assembly is utilized to bias the barrel toward the port plate and maintain intimate contact therebetween. The spring assembly comprises a stack of disk or Belleville springs disposed concentrically about the drive shaft between a shoulder on the shaft and an annular retainer which is threaded and received within a complementarily threaded opening in the barrel. The disk springs are configured to provide a substantially constant biasing force over a significant range of compression in order to provide a substantially constant bias driving the barrel against the port plate in spite of wear of the faces thereof or other operational variables. The constant bias characteristic of the disk springs also facilitates manufacture of the piston pump since the proper biasing force can effectively be provided by compressing the stack of disk springs a given linear dimension corresponding to the middle of the constant force region of its deflection (i.e., force versus distance) curve.

Thus it is object of the instant invention to provide an improved axial piston hydraulic device capable of operation as a pump or a motor.

It is a further object of the instant invention to provide an axial piston hydraulic device having spring means which provides a substantially constant force biasing the barrel toward the port plate.

It is a still further object of the instant invention to provide an axial piston hydraulic device having barrel to port plate biasing means which provides a substantially constant biasing force notwithstanding wear of the abutting barrel and port plate surfaces.

Other objects and advantages of the invention will become apparent from the following detailed description, with reference being made to the accompanying drawings.

BRIEF DESCRIPTION OF THE DRAWINGS

FIG. 4 is a cross-sectional view taken along line 4—4 of FIG. 2;

FIG. 5 is a cross-sectional view taken along line 5—5 of FIG. 4;

FIG. 6 is an exploded perspective view of the disk or Belleville spring assembly; and FIG. 7 is a deflection curve for the disk springs incorporated in the instant invention illustrating diagrammatically the region of constant force versus deflection.

DESCRIPTION OF THE PREFERRED EMBODIMENT

Figure 1:
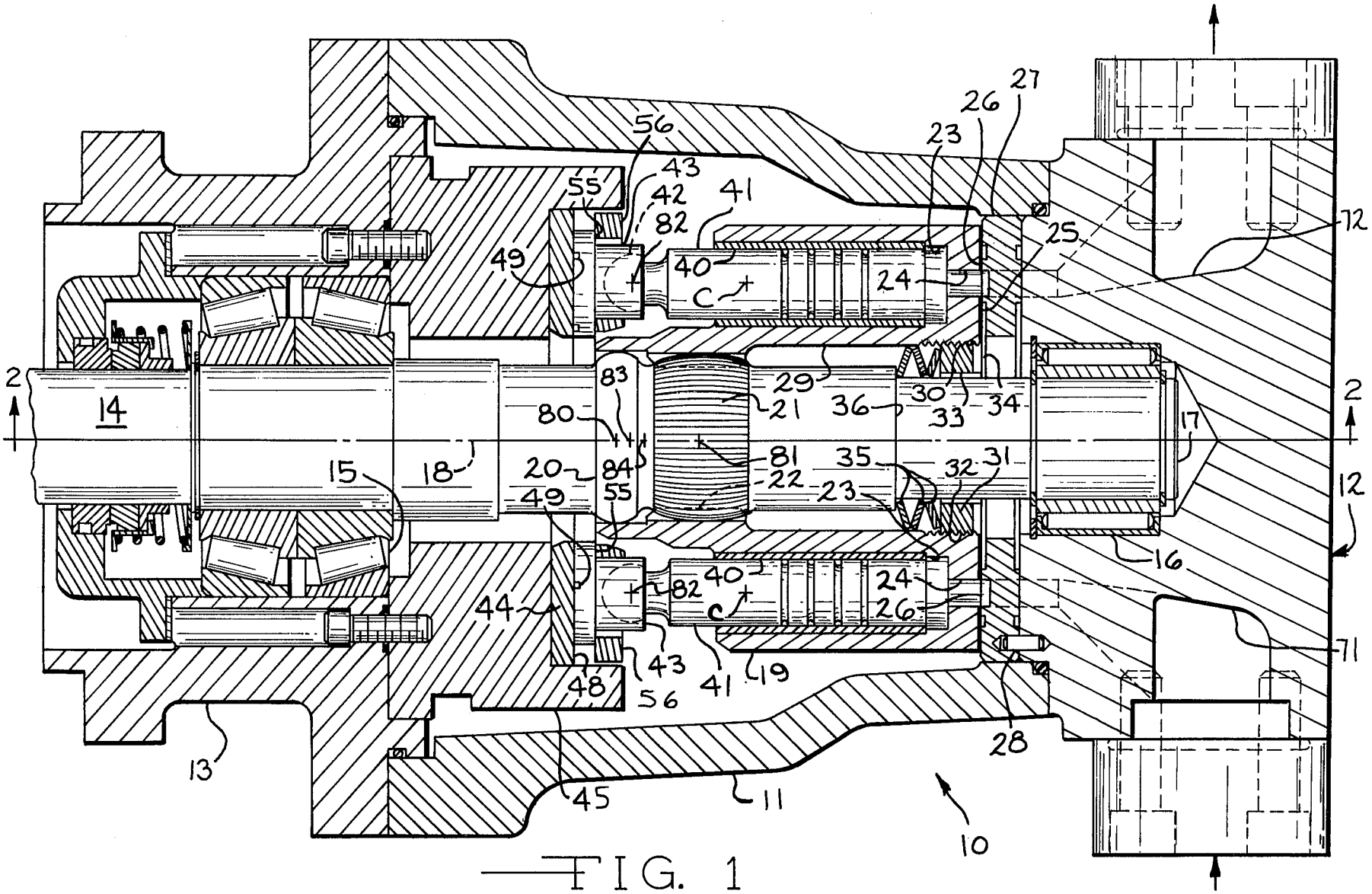
FIG. 1 is a side elevational, cross-sectional view of a hydraulic device incorporating the instant invention.
Figures 2, 3:
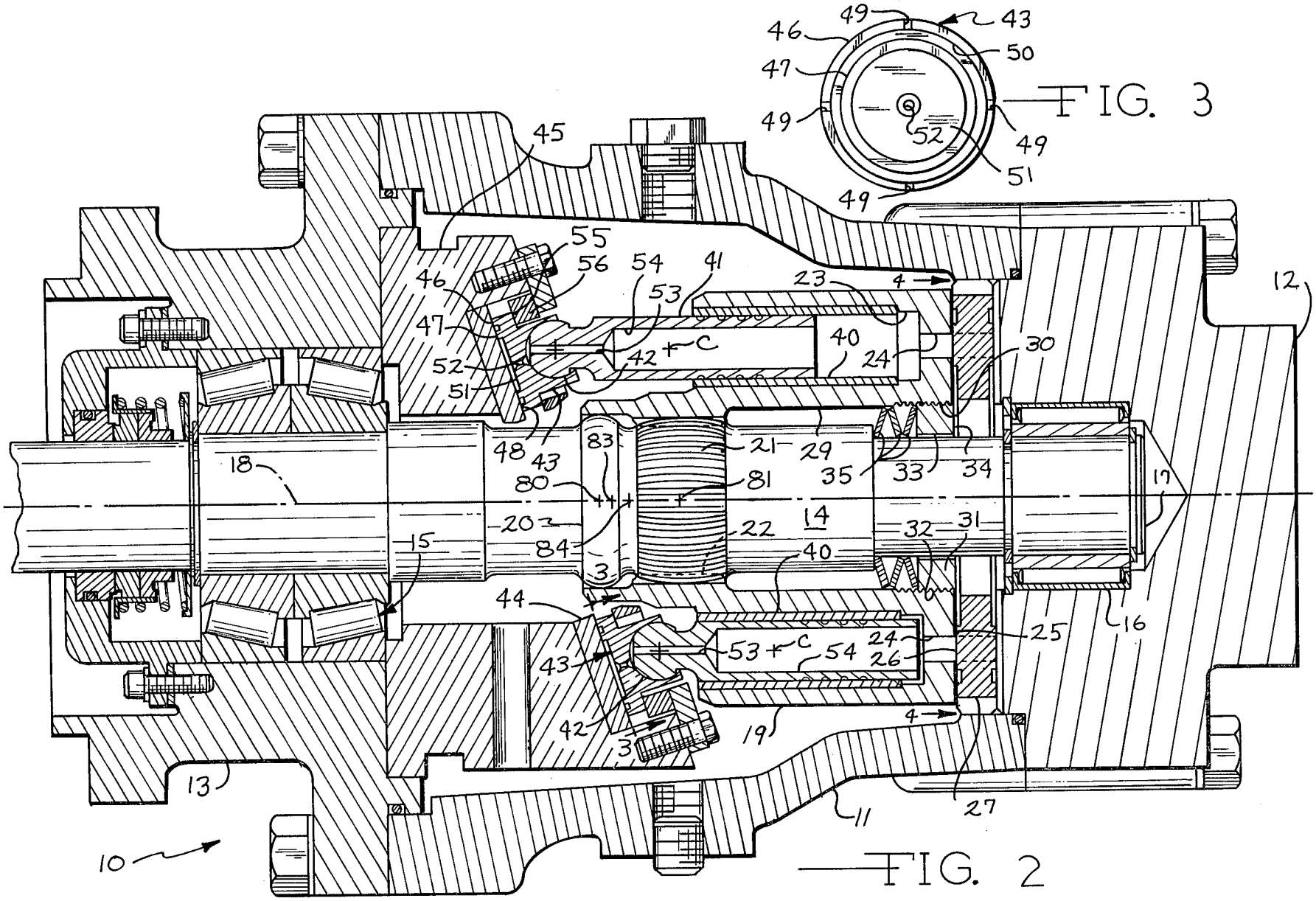
FIG. 2 is a cross-sectional view of a hydraulic device incorporating the instant invention taken along line 2—2 of FIG. 1.
FIG. 3 is a cross-sectional view taken along line 3—3 of FIG. 2 and showing details of the shoe lands which ride on the cam plate.

Referring now to the drawings and particularly to FIGS. 1 and 2, a high pressure axial piston hydraulic pump 10 is illustrated in accordance with the preferred embodiment of the invention. It should be understood that the pump 10 is a fluid energy translating device which may be operated as either a pump or a motor. The pump 10 is capable of high pressure continuous duty operation and, for example, may be operated at pressures on the order of 5,000 p.s.i. or more for extended periods of time.

The pump 10 includes a cylindrical or annular housing 11 having one end closed by a port cap 12 and an opposite end closed by a flange mount or base 13. A drive shaft 14 extends through the base 13 into the housing 11. A radial thrust bearing 15 supports the drive shaft within the base 13 and a bearing 16 supports an end 17 of the drive shaft 14 within the port cap 12. The shaft 14 has an axis 18 about which it rotates. A barrel 19 is disposed concentrically about the shaft 14. The barrel 19 contacts the surface of a crowned bearing 20 formed integrally on the shaft 14 and engages a set of crowned male splines 21 also integrally formed on the shaft 14. The male splines 21 engage a set of straight female splines 22 disposed on the inner surface of the barrel 19 to drivingly couple the barrel 19 to the drive shaft 14. The barrel 19 defines a plurality of cylinders 23 which are uniformly spaced from the axis 18 and which also are uniformly spaced circumferentially about the barrel 19. Each cylinder communicates through an intake/discharge passage 24 to an end surface 25 of the barrel 19. The barrel end surface 25 is preferably defined by a thin layer of bearing bronze or other suitable bearing material. The barrel end surface 25 abuts a surface 26 on a valve or port plate 27 which is fabricated of a material such as steel which is dissimilar to the bearing bronze of the barrel end surface 25. The port plate 27 is positioned between the barrel 19 and the port cap 12 and is indexed to the port cap 12 with a pin 28.

Referring now to FIGS. 1 and 6, the barrel 19 defines a concentric central cavity 29 having male threads 30 disposed on the inner surface thereof adjacent the end surface 25. An annular retainer 31 having female threads 32 complementary to the male threads 30 is received in the central cavity 29. The annular retainer 31 defines a concentric opening 33 which receives the drive shaft 14 and includes at least a pair of diametrically opposed blind holes or slots 34. The slots 34 facilitate engagement and rotation of the annular retainer 31 relative to the barrel 19 in order to provide adjustable axial restraint for a plurality, i.e., stack, of Belleville or disk springs 35. The plurality of disk springs 35 engages and is restrained by a shoulder 36 defined by the drive shaft 14. Preferably, means are also provided by which to secure the annular retainer 31 to the barrel 19. Such means may take the form of retaining pins, castellations on the retainer 31 or the use of resins or locking compounds on the threads 30 and 32.

As will become more apparent, the instant invention resides generally in the use of disk springs or other devices providing a substantially constant force over a range of compression or deflection in the mechanism and for the purpose described. Thus it should be noted that while the use of a plurality of disk springs is preferred a single disk spring or other device or devices exhibiting the deflection characteristics described below is construed to be within the scope of the instant invention. Since the shaft 14 is axially restrained by the radial thrust bearing 15, the plurality of disk springs 35 exert a force on the barrel 19 to bias the barrel 19 against the port plate 27. During startup and during zero pressure operation, a fluid tight seal between the stationary port plate 27 and the rotating barrel 19 is maintained by the spring force exerted on the barrel 19 by the springs 35. Under load, hydraulic pressure maintains the barrel 19 against the port plate 27.

Referring again to FIGS. 1 and 2, each of the cylinders 23 within the barrel 19 is partially lined with a sleeve 40 fabricated of suitable bearing material. A piston 41 is slidably disposed within each cylinder sleeve 40. Each piston 41 has a ball or spherical end 42 which rotates within a corresponding socket in a shoe 43. The shoes 43 ride on a cam plate 44 which is disposed at a fixed angle relative to the axis 18 within a stationary support 45. The cam plate 44 is free to rotate within the stationary support 45. Operated as a pump, the shaft 14 rotates the barrel 19 and the shoes 43 ride on the cam plate 44 to reciprocate the pistons 41 within the cylinder sleeves 40. The stationary support 45 and fixed angle of the cam plate 44 provide a fixed displacement for the pump 10. It will be appreciated that the cam plate 44 may be adjustably supported in order to provide a variable displacement pump, as is illustrated, for example, in my prior U.S. Pat. No. 3,126,835 and in other prior art.

Details of the shoes 43 are shown in FIGS. 2 and 3. Each shoe 43 has an outer annular tilt land 46 and an inwardly spaced annular balance land 47 which ride on a flat surface 48 on the cam plate 44. A plurality of radial slots 49 extend through the tilt land 46, and may, for example, be spaced 90° apart about the tilt land 46. An annular oil groove 50 is located between the two annular lands 46 and 47.

A central region 51 interior of the balance land 47 is spaced from the cam plate surface 48. In the center of the central region 51, an oil passage 52 is located for communicating with an oil passage 53 within the piston 41 connected to the shoe 43. During the pressure stroke of the connected piston 41, a small amount of the hydraulic fluid is forced through a hollow center 54 in the connected piston 41, the piston passage 53, the shoe passage 52 to the central region 51 between the shoe 43 and the cam plate 44. From the central region 51, a small amount of the hydraulic fluid flows between the balance land 47 on the shoe 43 and the cam plate surface 48 and then through the oil groove 50 and out the grooves 49 in the tilt land 46. The limited oil flow provides pressure balance of the forces on the shoes 43 and also produces a hydrostatic bearing between the cam plate surface 48 and the shoes 43 which permits them to readily slide over the cam plate surface 48 while under load.

The outer surface of each shoe 43 is provided with a step 55 which is engaged by an annular retainer 56 which is parallel to the surface 48. The spacing between the retainer 56 and the cam plate surface 48 is only slightly greater than the thickness of the steps 55 on the shoes 43 so that the shoes 43 are free to rotate and slide on the cam plate 44 but are held in close contact with the cam plate 44. In prior art axial piston pumps, the shoes were generally formed from a bearing material, such as bronze. In the pump 10, the shoes 43 are formed from steel and have a layer of bronze bonded to the lower surface for forming at least the surface portions of the lands 46 and 47 which contact the cam plate surface 48. Since the shoes 43 are primarily formed from steel, metal fatigue is negligible and it is unnecessary to provide hydraulic hold down for the pistons 41 to urge the pistons 41 toward the cam plate 44. Such a hydraulic hold down arrangement is illustrated, however, in my prior U.S. Pat. No. 3,160,109.

Turning now to FIGS. 4 and 5, details of the port plate 27 are illustrated. The port plate 27 is generally disc-like, having a side 26 which contacts the surface 25 on the barrel 19 and having an opposite side 60 which contacts the port cap 12. The port plate 27 defines a concentric opening 61 which freely receives the shaft 14 and has a periphery 62 which abuts the housing 11. A single arcuate intake port 63 is formed in the port plate surface 26. The intake port 63 communicates with two complementarily disposed arcuate intake passages 64 and 65 which extend through the port plate 27. The passages 64 and 65 are separated by a web 66 which is spaced from the surface 26. Similarly, a single arcuate discharge port 67 is formed in the port plate surface 26 and communicates with two complementarily disposed arcuate discharge passages 68 and 69 which extend through the port plate 27. The passages 68 and 69 are separated by a reinforcement web 70 which is spaced from the surface 26. The intake passages 64 and 65 communicate with an intake passage 71 in the port cap 12 and the discharge passages 68 and 69 communicate with a discharge passage 72 in the port cap 12 (FIG. 1). As viewed in FIG. 4, the barrel 19 rotates relative to the port plate 27 in a clockwise direction so that the intake/discharge passage 24 of each of the cylinders 23 sweeps clockwise over the intake port 63, over a surface region 73 as the piston passes bottom dead center, over the discharge port 67 and then over a surface area 74 as the piston passes top dead center. The leading edges 75 of the ports 63 and 67 are tapered so as to provide a smooth transition as the barrel passages 24 sweep from the surface 74 to the port 63 and from the surface 73 to the port 67.

As previously stated under the description of FIGS. 1 and 2, both the bearing 20 and the male splines 21 on the drive shaft 14 are crowned or curved in profile. The curvature is exaggerated in FIGS. 1 and 2 and may, for example, only be on the order of 0.006 inches or less over the length of the splines 21. The crowned bearing 20 has a center 80 and the crowned male splines 21 have a center 81. The bearing and spline centers 80 and 81 are located on the shaft axis 18. As discussed in my prior U.S. Pat. No. 3,126,835 each piston spherical end 42 has a center of curvature 82. The bearing centers 82 lie in a plane which intersects the shaft axis 18 at a point 83. The point 83 is located between the crowned bearing center 80 and the crowned spline center 81.

Referring now to FIGS. 1 and 6 and especially FIG. 7, the features and utility of the Belleville or disk springs 35 according to the instant invention will be more fully described. As previously noted, hydraulic pressure on exposed surfaces of the barrel 19 provides a biasing force which urges the barrel against the port plate 27 at operating speeds and pressures. However, at startup, low rotational speeds and low pressures, this biasing force is negligible and therefore must be provided by other means. Specifically, the disk springs 35 provide this biasing force.

The disk springs 35 are an improvement over springs such as conventional coil springs utilized in the prior art inasmuch as they may be fabricated to provide highly non-linear force versus deflection relationships. Specifically, they may be fabricated, and it is intended that the disk springs 35 utilized in the instant invention be so fabricated, as to provide a force versus deflection relationship wherein the compressive force remains constant or substantially constant over a significant range of deflection. This is in direct distinction to conventional coil springs which have a constant, directly proportional relationship between force and deflection.

Such a constant force characteristic provides several benefits. First of all, it allows adjustment of the axial position of the spring retainer 31 by actual mechanical position rather than measured spring force in order to provide a given, required bias of the barrel 19 toward the port plate 27. Inspection of the curve of FIG. 7 reveals that force produced by deflection of the disk springs 35 represented by the line A will vary only negligibly as the deflection, i.e., compression, of the spring varies widely. This characteristic of the disk springs 35 facilitates assembly of the axial piston and hydraulic pump 10 since accurate setting of the biasing force of the barrel 19 against the port plate 27 may be achieved by simply rotating and axially advancing the annular retainer 31 to provide approximate nominal clearance between itself and the shoulder 36 on the drive shaft 14. Preferably, this clearance will place the disk springs 35 under compression or deflection generally corresponding to the line A in the middle of their force versus deflection curves corresponding to the substantially constant force region. Should piece to piece dimensional variation occur, and the actual clearance in a given pump 10 vary somewhat from the nominal value, the actual biasing force provided by the springs 35 will vary by a negligible amount. It should be noted that this adjustment step may be readily accomplished prior to the final assembly of the pump 10. It should likewise be appreciated that the utilization of the disk springs 35 therefore eliminates repeated spring adjustment and bias force measuring steps which would be necessary to properly set the spring bias if conventional coil springs were utilized.

The disk springs 35 also confer benefits during the service life of the pump 10. Specifically, the barrel end surface 25 and the surface 26 of the port plate 27 will slowly wear as the pump 10 is operated. Such wear will result in increased clearance between the annular retainer 31 and the shoulder 36 on the drive shaft 14. Again, if a conventional coil spring were to be utilized, the force provided would steadily reduce with increased wear. With the disk springs 35, however, a significant reduction in the compression or deflection of the disk springs 35 would be necessary before any significant reduction in the biasing force occurred.

It will be appreciated that various modifications and changes may be made in the above described preferred embodiment of the invention. For example, the shoes 43 were illustrated as being formed from steel and having a bronze friction surface for engaging the cam plate 44. It should be appreciated that solid bronze shoes may be used in place of the steel shoes and that the shoes may be held in contact with the cam plate 44 through a conventional prior art hydraulic hold down system which applies a hold down pressure to the pistons. It also will be appreciated that the cam plate 44 is illustrated as having a fixed annular position. However, the cam plate 44, as noted above, may be mounted for tilting to provide a variable displacement pump. Furthermore, it will be noted that although the device 10 has been described as a pump, it also may be operated as a motor merely by forcing a flow of pressurized hydraulic fluid through the device 10.

The foregoing disclosure is the best mode devised by the inventor for practicing this invention. It is apparent, however, that devices incorporating modifications and variations will be obvious to one skilled in the art of axial piston pumps. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What is claimed is:

1. A fluid energy translating device including a housing having inlet and outlet passages, a port plate mounted in said housing and having inlet and outlet ports communicating with said inlet and outlet passages in said housing, a rotatable cylinder barrel abutting said port plate, having an axis of rotation perpendicular to said port plate and defining a centrally disposed through bore and a plurality of cylinders arranged about such axis of rotation, each cylinder having an axis spaced from and parallel to such axis of rotation, a piston in each cylinder, cam means for reciprocating said pistons as said barrel rotates, a drive shaft extending coaxially through said barrel and rotatably supported in said housing, means for rotatably coupling said barrel and said drive shaft, compression spring means operably disposed between said barrel and said drive shaft for providing a substantially constant force biasing said barrel against said port plate notwithstanding axial movement of said barrel over a limited distance and means for adjusting such biasing force.

2. The fluid energy translating device of claim 1 wherein said compression spring is a disk spring having a non-linear force versus deflection characteristic.

3. The fluid energy translating device of claim 1, wherein said means for rotatably coupling said barrel and said drive shaft includes a set of straight female splines disposed within said centrally disposed through bore and a set of crowned male splines on said drive shaft.

4. The fluid energy translating device of claim 1 wherein said means for adjusting said biasing force includes an annulus disposed concentrically about said drive shaft and having threads, said threads engaging complementarily disposed threads on said barrel.

5. In an axial piston energy translating device of the type including a barrel defining a plurality of cylinders and a centrally disposed shaft receiving passage, a plurality of pistons slidably positioned within a respective one of said cylinders, a drive shaft extending through said passage, means for rotatably coupling said barrel to said drive shaft, and a port plate disposed in abutting contact with one end of said barrel, the improvement comprising compression spring means operably disposed between such drive shaft and such barrel for biasing said barrel toward said port plate with a force which is substantially constant over a limited range of axial movement of said barrel and a fixed spring receiving stop on such drive shaft and an axially adjustable spring receiving stop removably secured to such barrel.

6. The improvement of claim 5 wherein said axially adjustable spring receiving stop is an annulus concentrically disposed about such drive shaft and including male threads, said male threads received within complementary female threads disposed in such barrel.

7. The improvement to claim 5 wherein said compression spring means includes at least one spring having a non-linear force versus deflection relationship.

8. The improvement of claim 5 or claim 7 wherein said compression spring means includes at least one disk spring.

9. The improvement of claim 5 or claim 7 wherein said compression spring means includes a plurality of disk springs.

* * * * *